US007825883B2

(12) United States Patent
Yao

(10) Patent No.: US 7,825,883 B2
(45) Date of Patent: Nov. 2, 2010

(54) METHOD FOR CONTROLLING A UNIVERSAL BACKLIGHT INVERTER

(75) Inventor: Kaiwei Yao, Santa Clara, CA (US)

(73) Assignee: Monolithic Power Systems, Inc., San Jose, CA (US)

( * ) Notice: Subject to any disclaimer, the term of this patent is extended or adjusted under 35 U.S.C. 154(b) by 809 days.

(21) Appl. No.: 11/735,370

(22) Filed: Apr. 13, 2007

(65) Prior Publication Data

US 2007/0242022 A1 Oct. 18, 2007

Related U.S. Application Data

(60) Provisional application No. 60/792,113, filed on Apr. 14, 2006.

(51) Int. Cl.
*G09G 3/36* (2006.01)

(52) U.S. Cl. ..... 345/87; 345/99; 345/102

(58) Field of Classification Search ..... 345/87, 345/99, 102, 204, 211, 212, 905; 315/169.3, 315/224, 302; 368/67; 348/221.1; 178/18.04
See application file for complete search history.

(56) References Cited

U.S. PATENT DOCUMENTS 4,644,100 A * 2/1987 Brenner et al. ..... 178/18.04
5,591,945 A * 1/1997 Kent ..... 178/18.04
5,790,096 A * 8/1998 Hill, Jr. ..... 345/600
6,437,824 B1 * 8/2002 Suzuki et al. ..... 348/222.1
6,501,234 B2 * 12/2002 Lin et al. ..... 315/307
6,587,101 B2 * 7/2003 Yoo ..... 345/211
7,477,228 B2 * 1/2009 Wyatt ..... 345/102
7,562,242 B2 * 7/2009 Hori ..... 713/324
2002/0039153 A1 * 4/2002 Yoo ..... 348/730
2002/0125863 A1 * 9/2002 Lin et al. ..... 323/234
2004/0160408 A1 * 8/2004 Hwang ..... 345/102
2004/0183469 A1 * 9/2004 Lin et al. ..... 315/247
2005/0068289 A1 * 3/2005 Diefenbaugh et al. ..... 345/102
2006/0001641 A1 * 1/2006 Degwekar et al. ..... 345/102
2006/0206734 A1 * 9/2006 Hori ..... 713/300
2006/0279523 A1 * 12/2006 Nitta et al. ..... 345/102
2008/0238859 A1 * 10/2008 Kim et al. ..... 345/102
2009/0072754 A1 * 3/2009 Fukumoto ..... 315/279

* cited by examiner

*Primary Examiner*—Prabodh M Dharia
(74) *Attorney, Agent, or Firm*—Perkins Coie LLP

(57) ABSTRACT

The present invention introduces methods to modify the burst frequency of an inverter in a given LCD panel without any component change on the inverter board. The present invention also introduces methods to adjust the setting of a sensing system for duty cycles and accept Display Power Saving Technology (DPST) input signals with different frequencies. The universal inverter module with the present invention can be applied for different DPST technologies.

7 Claims, 1 Drawing Sheet

METHOD FOR CONTROLLING A UNIVERSAL BACKLIGHT INVERTER

CROSS-REFERENCE TO RELATED APPLICATION

This application claims priority to U.S. provisional patent application Ser. No. 60/792,113, filed on Apr. 14, 2006, which is hereby incorporated herein by reference.

TECHNICAL FIELD

The present invention relates generally to an inverter, and more particularly to frequency control of the inverter through a communication bus.

BACKGROUND

The LCD panel consumes a large percentage of the total power in cell phones, PDA etc. It is a constant challenge to reduce the power consumption of LCD panels while maintaining the same or better image quality. Burst operation is a commonly used method of adjusting LCD brightness in a backlight inverter. However, when burst operation is used, it's critical to choose a proper operation frequency in a given LCD panel in order to prevent panel flicker or display noise. Typically, different inverter modules are required since different LCD panels require different burst frequencies.

One solution to the above problem is to incorporate different oscillators with resistors and capacitors in different LCD panels. However, the manufacturing cost significantly increases.

Another solution is to use Display Power Saving Technology (DPST) and reduce backlight illumination by altering the image brightness and contrast within an image while maintaining overall display quality. With DPST technology, a graph card or panel generates a pulse-width-modulation (PWM) signal, whose duty cycle is used to adjust the lamp brightness and controlled by the relative brightness of the display. However, the frequency of PWM signals varies with different DPST technologies. As a result, different inverter modules are required to sense the duty cycle of PWM signals with different frequencies. It is desirable to have a universal inverter module suitable for different LCD panels and DPST technologies.

BRIEF DESCRIPTION OF DRAWINGS

The following figures illustrate examples of the present invention. These figures and examples provide examples of the invention and they are non-limiting and non-exhaustive.

SUMMARY OF THE INVENTION

The present invention overcomes the aforementioned problems by setting the burst output frequency and DPST input frequency of a backlight inverter through a communication bus.

In one embodiment of the present invention, a method presented can modify the burst frequency of the inverter in a given LCD panel without any component change on the inverter board.

In another embodiment of the present invention, a method presented can adjust the setting of a sensing circuit for duty cycle and accept DPST input signals with different frequencies by writing to a bus controller through a communication bus. As a result, a universal inverter module can be applied for different DPST technologies.

DETAILED DESCRIPTION

Embodiments of methods to control a universal backlight inverter are described in detail herein. In the following description, some specific details, such as example values for these system components, are included to provide a thorough understanding of embodiments of the invention. One skilled in relevant art will recognize, however, that the invention can be practiced without one or more specific details, or with other methods, components, materials, etc.

The following embodiments and aspects are illustrated in conjunction with systems, circuits, and methods that are meant to be exemplary and illustrative. In various embodiments, the above problem has been reduced or eliminated, while other embodiments are directed to other improvements.

In the present invention, a bus controller functions as an interface between a computer system and an inverter board. The communication is based on a protocol through a System Management Bus (SMBus) or an Inter-IC-bus (IIC bus) or any other type of buses, also called "bus". The bus controller sets a default burst frequency and a default DPST input signal frequency of the inverter. The computer system can write to the bus controller through the "bus", modify the burst frequency, and adjust the settings to accept those DPST input signals with different frequencies.

Figure 1:
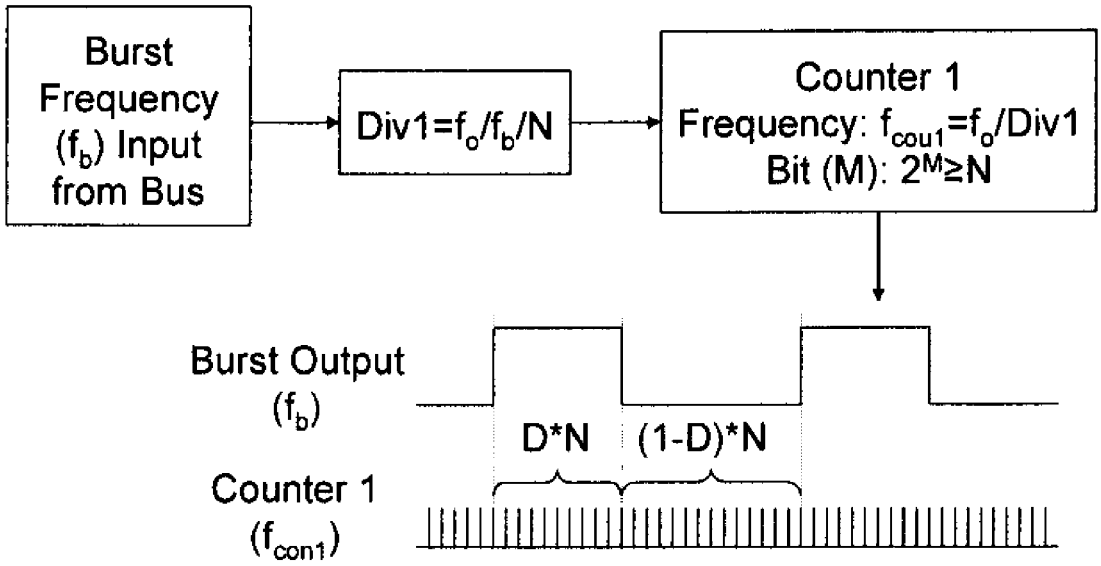
FIG. 1 is one embodiment of the present invention.

FIG. 1 illustrates one embodiment of the present invention. Assume N is the required resolution step, $f_0$ is the reference oscillator frequency, $f_b$ is the required burst frequency, and D is the duty cycle. A desired first frequency divider number Div1 equals to $f_0/(f_b*N)$. A first counter frequency $f_{cou1}$ equals to $f_0$/div1. If we assume N=256, $f_0$=8 MHz, $f_b$=200 Hz, and D=0.6, then Div1=8 MHz/(200 Hz*256)=156, and $f_{cout1}$=8 MHz/156=51.2 KHz. The counter is required to have enough bits, M, so that $2^M \geqq N$, and can handle the step value (N) without overflow.

In order to generate a burst output signal, the bus controller relies on the counter. The counter starts to count D*N when the high level portion of the burst signal is detected and triggers the low level portion of the burst output signal after D*N count completes. Further, the counter starts to count (1−D)*N when the low level portion of the burst signal is detected and triggers the high level portion of the burst output signal after (1−D)*N count completes. The same process is repeated by the counter and the bus controller until the bus controller modifies the process. This is illustrated in the lower portion of FIG. 1.

Figure 2:
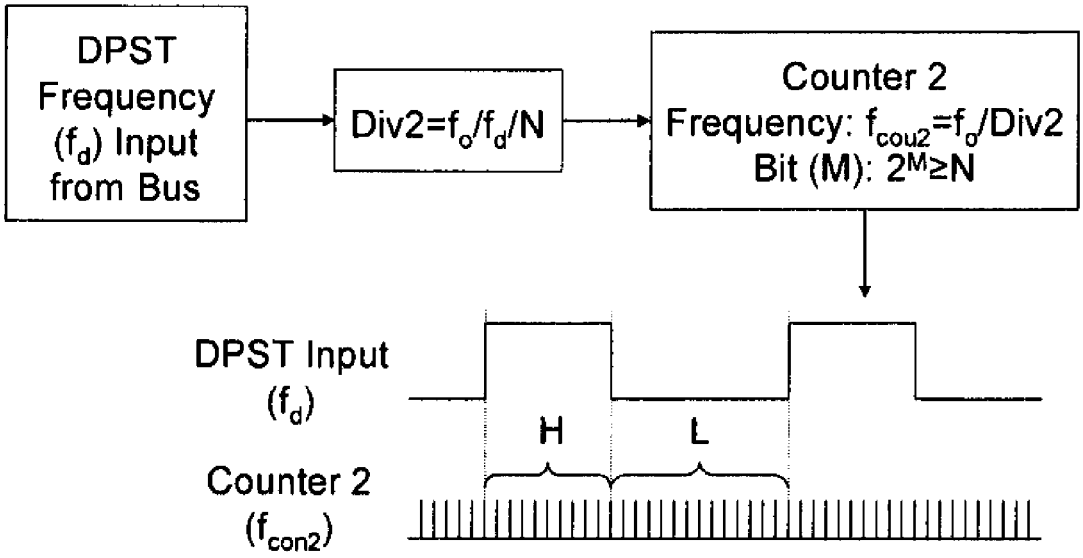
FIG. 2 is another embodiment of the present invention.

FIG. 2 illustrates another embodiment of the present invention. Assume $f_d$ is the required DPST input frequency. A desired second frequency divider number Div2 equals to $f_0/(f_d*N)$. A second counter frequency $f_{cou2}$ equals to $f_0$/Div2. If we assume N=256, $f_0$=8 MHz, and $f_d$=10 KHz, then Div2=8 MHz/(10 KHz*256)=3.125, and $f_{cout2}$=8 MHz/3.125=2.56 MHz. The second counter is required to have enough bits, M, so that $2^M \geqq N$ and can handle the step value (N) without overflow.

The counter starts to count a high level count, H, when a high level of the DPST input signal is detected and stops counting H when a low level of the DPST input signal is detected. Further, the counter starts to count a low level count, L, when the low level of the DPST input signal is detected and stops counting L when the high level of the DPST input signal is detected. The duty cycle equals to D=H/(H+L). This is illustrated in the lower portion of FIG. 2.

In yet another embodiment of the present invention, the input data that sets the burst output frequency and the DPST input frequency through the bus can be either a real value or one from a look-up table. The setting can be a one-time action. A new burst output frequency and DPST input frequency data can be stored or burned inside the bus controller permanently, or programmed repeatedly. For example, the data can be updated during each power up period.

The description of the invention and its applications as set forth herein is illustrative for controls of a universal backlight inverter and is not intended to limit the scope of the invention. Variations and modifications of the embodiments disclosed herein are possible, and practical alternatives to and equivalents of the various elements of the embodiments are known to those of ordinary skill in the art. Other variations and modifications of the embodiments disclosed herein may be made without departing from the scope and spirit of the invention.

What is claimed is:

1. A method for deriving a burst output signal in a LCD panel, wherein said LCD panel contains an inverter and a computer system, wherein said inverter has a duty cycle D and contains a bus controller and a counter, comprising:

sending a predetermined burst frequency from said computer system to said bus controller through a bus;

deriving the frequency of said counter through said bus controller, wherein the frequency of said counter is at least the required resolution steps, N, times the required burst frequency, wherein said counter has M bits and $2^M \geqq N$;

deriving the high level portion of said burst output signal through said inverter by counting D*N through said counter, wherein said counter starts to count after the high level portion is detected and triggers the low level of said burst output signal after D*N counts; and deriving the low level portion of said burst output signal through said inverter by counting (1−D)*N through said counter, wherein said counter starts to count after the low level portion is detected and triggers the high level of said burst output signal after (1−D)*N counts.

2. The method of claim 1, wherein said burst output signal can be either stored in said bus controller permanently, or programmed repeatedly.

3. The method of claim 1, wherein said bus is either a System Management Bus (SMBus) or an Inter-IC-bus (IIC bus).

4. The method of claim 1, wherein said predetermined burst frequency is either a real value or a value from a lookup table.

5. A method for sensing the duty cycle of a Display Power Saving Technology (DPST) input signal in a LCD panel, wherein said LCD panel contains a graphic card, an inverter, and a computer system, wherein said inverter contains a bus controller and a counter, comprising:

sending said DPST input signal from said graphic card to said bus controller;

deriving the frequency of said counter through said bus controller, wherein the frequency of said counter is at least the required resolution steps, N, times the frequency of said DPST input signal, wherein said counter has M bits and $2^M \geqq N$;

deriving a high level count, H, through said counter when said DPST input signal is high, wherein said counter starts to count said high level count when the high level of said DPST input signal is detected and stops counting said high level count when the low level of said DPST input signal is detected;

deriving a low level count, L, through said counter when said DPST input signal is low, wherein said counter starts to count said low level count when the low level of said DPST input signal is detected and stops counting said low level count when the high level of said DPST input signal is detected; and deriving said duty cycle of said DPST input signal by dividing H over (H+L) through said bus controller.

6. The method of claim 5, wherein said bus is either a System Management Bus (SMBus) or an Inter-IC-bus (IIC bus).

7. The method for digitally transferring a Display Power Saving Technology (DPST) signal in a LCD panel, wherein said LCD panel contains a graphic card, an inverter, and a computer system, wherein said inverter contains a bus controller and a counter, comprising:

obtaining a DPST signal digitally from said graphic card through said computer system through a bus; and sending said DPST signal from said computer system to said bus controller through said bus.

* * * * *